US006981473B2

(12) United States Patent
Gunji et al.

(10) Patent No.: US 6,981,473 B2
(45) Date of Patent: Jan. 3, 2006

(54) CYLINDER HEAD FOR AN INTERNAL COMBUSTION ENGINE

(75) Inventors: Toru Gunji, Saitama (JP); Hiromi Sumi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/769,284

(22) Filed: Jan. 30, 2004

(65) Prior Publication Data

US 2004/0206314 A1 Oct. 21, 2004

(30) Foreign Application Priority Data

Feb. 6, 2003 (JP) ..... 2003-030095

(51) Int. Cl.
*F02F 1/36* (2006.01)

(52) U.S. Cl. ..... 123/41.82 R; 123/193.5

(58) Field of Classification Search ..... 123/41.82 R, 123/193.5
See application file for complete search history.

(56) References Cited

U.S. PATENT DOCUMENTS 4,993,227 A * 2/1991 Nagura et al. ..... 123/41.82 R

FOREIGN PATENT DOCUMENTS

| | | |
|---|---|---|
| DE | 35 46 436 | 10/1986 |
| EP | 1 143 135 | 10/2001 |
| JP | 40218/1989 | 8/1989 |
| JP | 5081/1990 | 2/1990 |
| JP | 02275011 | 11/1990 |
| JP | 07217494 | 8/1995 |
| JP | 09032633 | 2/1997 |
| JP | 10103053 | 4/1998 |
| JP | 2000087798 A | 3/2000 |

* cited by examiner

*Primary Examiner*—Noah P. Kamen
(74) *Attorney, Agent, or Firm*—Carrier, Blackman & Associates, P.C.; William D. Blackman; Joseph P. Carrier

(57) ABSTRACT

A cylinder head, for an internal combustion engine, enhances engine efficiency while ensuring favorable coolant flow. The cylinder head includes a main casting body 41 having a hollow water jacket formed therein, to allow coolant flow therethrough. The main casting body 41 includes a plurality of cylindrical plug hole walls 91 which have plug holes 90 formed therein inside a head-side water jacket 60. The cylinder head also includes partitions 100, formed inside the head-side water jacket 60, and these partitions connect the plug hole walls 91 together form a dividing wall, which divides the water jacket into an exhaust port section and an intake port section. Coolant entering the water jacket is divided into two substreams, which flow initially in substantially opposite directions, and which are reunited after flowing around opposite ends of the dividing wall.

18 Claims, 8 Drawing Sheets

CYLINDER HEAD FOR AN INTERNAL COMBUSTION ENGINE

CROSS-REFERENCE TO RELATED APPLICATION

The present application claims priority under 35 USC 119 based on Japanese patent application No. 2003-030095, filed Feb. 6, 2003.

BACKGROUND OF THE INVENTION

1. Field of the Invention

The present invention relates to an improved cylinder head for a multi-cylinder, water-cooled internal combustion engine. More particularly, the present invention relates to an improved cylinder head having improved coolant flow and operating efficiency.

2. Description of the Background Art

Many different designs for internal combustion engines are known, including reciprocating engines for vehicles or the like, and water-cooled internal combustion engines which exhibit high cooling performance. In one known design for internal combustion cylinder heads, the flow of coolant is travels through two parallel coolant passages formed along a cylinder row direction (see, for example, Japanese Patent Publication No. 40218/1989 and Japanese Utility Model Publication No. 5081/1990).

In another known design for cylinder heads, a coolant outlet is formed approximately centrally in the head and extends in a cylinder row direction, with a wall extending in the cylinder row direction and dividing the inside of a water jacket into the outlet side and a main coolant passage side. In this second known design, coolant which flows in the water jacket is made to flow into the main coolant passage from both sides in the cylinder row direction to the outlet side, and the coolant then advances to the coolant outlet (see, for example, Japanese Patent Laid-Open No. 2000-87798). To make the flow of coolant uniform in this manner is helpful in equalizing the temperature throughout the cylinder head, and suppressing the occurrence of a temperature gradient in the cylinder row direction of the cylinder head.

The above-described cylinder head is generally a cast product with a complicated structure for holding a large number of dynamic valve systems, and hence, there is still a need for a novel structure which makes the flow of coolant uniform, enhances engine efficiency, and enables weight reduction.

Although the known devices have some utility for their intended purposes, there is still a need to provide a cylinder head of a water-cooled multi-cylinder internal combustion engine. In particular, there is a need for an improved cylinder head of a water-cooled multi-cylinder internal combustion engine with improved coolant flow and cylinder head efficiency, designed to solve the above-mentioned problems.

SUMMARY OF THE INVENTION

The present invention has been made in view of circumstances described above, and it is an object of the present invention to enhance engine efficiency while maintaining a favorable coolant flow, and to reduce weight of a cylinder head for an internal combustion engine.

As means for solving the above-mentioned problem, the invention described in a first aspect hereof is characterized in that, in a cylinder head for an internal combustion engine, a plurality of plug hole walls (for example, plug hole walls 91 in the depicted embodiment) which define plug holes (for example, plug holes 90 in the depicted embodiment) are formed in a water jacket (for example, a head-side water jacket 60 in this embodiment) of a main casting body (for example, a main casting body 41 in the depicted embodiment). A connection wall, which connects the plug hole walls (for example, a partition 100 in the depicted embodiment) with each other is integrally formed as part of the main casting body, and divides the water jacket into an intake port section and an exhaust port section.

According to the above-mentioned cylinder head for and internal combustion engine, the connection wall which is provided between the plug hole walls functions to divide the waterjacket into two sections, and hence, it is possible to direct coolant which flows in at the upstream side of the water jacket, partitioned by the connection wall, into two substreams initially flowing in substantially opposite directions to the downstream side of the connection wall, where the substreams are reunited.

Further, by connecting respective plug hole walls using the connection wall, at the time of casting the cylinder head, portions of the connection walls define a molten metal passage around the plug hole walls and hence, the flow of molten metal around the plug hole walls where intake passages, exhaust passages and the like are densely arranged can be improved.

Still further, a mating surface of the cylinder head between respective cylinders and the cylinder block is reinforced by the connection wall, which is arranged in the water jacket disposed above the cylinder head, and hence, it is possible to reduce the thickness of the periphery of the mating surface.

The invention according to a second aspect hereof is characterized in that, in a cylinder head for an internal combustion engine, a plurality of plug hole walls (for example, plug hole walls 91 in the depicted embodiment) which define plug holes (for example, plug holes 90 in the depicted embodiment) are formed in a waterjacket (for example, a head-side waterjacket 60 in the depicted embodiment) of a main casting body (for example, a main casting body 41 in the depicted embodiment). A plurality of partitions (for example, partitions 100 in the depicted embodiment) are disposed inside of the water jacket and extend between the plug hole walls, and a portion of each partition is cut by an access hole (for example, an access hole 110 in the depicted embodiment). A sand removing plug (for example, a plug 111 in the depicted embodiment) is installed in the access hole, and a gap is left open between the sand removing plug and the partition.

According to the above-mentioned cylinder head design for an internal combustion engine, it is possible to direct coolant, which flows in the upstream (exhaust port) side of the water jacket, into two substreams which initially flow in substantially opposite directions around the partition between respective plug hole walls in the direction from both sides in the cylinder row direction to the downstream side.

Further, by connecting respective plug hole walls using the partition, at the time of casting the cylinder head, portions of the partitions define a molten metal passage around the plug hole walls and hence, the flow of molten metal around the plug hole walls where intake passages and exhaust passages and the like are densely arranged can be improved.

Still further, a mating surface of the cylinder head between the respective cylinders and the cylinder block is reinforced by the partition which is arranged in the water jacket disposed above the cylinder head and hence, it is possible to reduce the thickness of the periphery of the mating surface of the cylinder head.

Further, by forming the access hole which cuts away the portion of the partition, after casting, sand can be simultaneously removed from both coolant passages of the water jacket which are partitioned by the partition and, at the same time, by providing the gap between the sand removing plug and the partition, stay or dwelling of air in coolant between respective plug hole walls can be suppressed.

For a more complete understanding of the present invention, the reader is referred to the following detailed description section, which should be read in conjunction with the accompanying drawings. Throughout the following detailed description and in the drawings, like number refer to like parts.

DETAILED DESCRIPTION

A number of selected illustrative embodiments for carrying out the present invention is explained hereinafter, in conjunction with the drawings. It should be understood, however, that the described embodiments are intended to illustrate, rather than to limit the invention.

Figure 1:
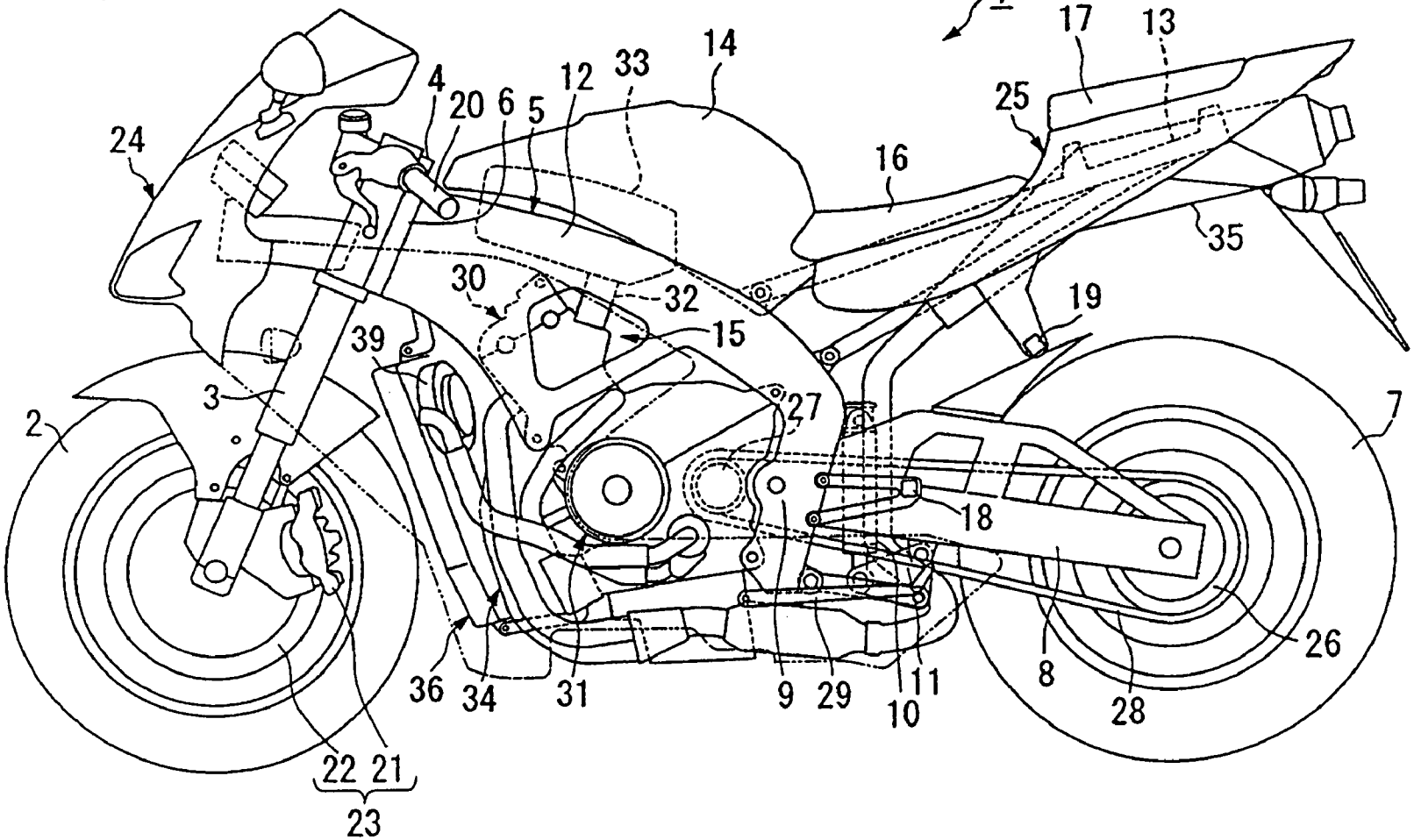
FIG. 1 is a side view of a motorcycle, which incorporates a cylinder head according to a first selected illustrative embodiment of the present invention.

FIG. 1 illustrates a motorcycle 1 with an engine incorporating a cylinder head according to a selected illustrative embodiment of the present invention. As shown in FIG. 1, a front fork 3, which rotatably supports a front wheel 2 of the motorcycle 1, is pivotally supported in a steerable manner on a vehicle body frame 5. The vehicle body frame 5 includes a head pipe 6, connected to a front end portion of the frame 5 by way of a steering stem 4. A rear fork 8, which rotatably supports a rear wheel 7, is tiltably and pivotally supported on a pivot portion 9 of the vehicle body frame 5.

The motorcycle also includes an engine body 15, mounted on an intermediate portion of the vehicle body frame 5. A rear shock absorber 10 has its upper end attached to the vehicle body frame 5, adjacent a pivot shaft of the rear fork 8. The lower end of the rear shock absorber 10 is mounted on a lower portion of the engine body 15, by way of a link mechanism 11. The rear shock absorber 10 absorbs an impact to prevent the impact from jarring the vehicle body frame 5, by way of the rear wheel 7 and the rear fork 8.

A main frame member 12 of the vehicle body frame 5 is separated in the left and right direction and extends rearwardly and downwardly from an upper portion of the head pipe 6, while rear end portions of the main frame member 12 are bent downwardly and are connected to the pivot portion 9. A seat frame 13 of the vehicle body frame 5 is connected to a rear portion of the main frame member 12. A fuel tank 14 is installed above the main frame member 12, while the engine body 15 of a water-cooled parallel four cylinder engine, according to the present invention, is arranged below the main frame member 12.

A driver's seat 16 and a rear pillion seat 17 are respectively supported on the seat frame 13, behind a rear portion of the fuel tank 14. Further, a driver's step 18 is mounted on the main frame member 12, behind the pivot portion 9, while a rear occupant step 19 is mounted on a lower portion of the seat frame 13. Further, a pair of left and right handle grips 20 are mounted on respective ends of a handlebar, at an upper end portion of the front fork 3.

A brake caliper 21 is mounted on a lower end portion of the front fork 3 and a brake rotor 22, corresponding to the brake caliper 21, is mounted on the front wheel 2. The brake caliper 21 and the brake rotor 22 constitute a front brake device 23. A rear brake device (not shown in the drawing) is also provided at the right side of the rear wheel 7, having a constitution substantially similar to the constitution of the front brake device 23.

A front portion of the body of the motorcycle 1 is covered with a front cowl 24, while a periphery of the seat frame 13 is covered with a rear cowl 25.

A rear sprocket 26 is mounted on the left side of the rear wheel 7, and a drive chain 28 is wound around the rear sprocket 26 and a drive sprocket wheel 27 arranged at the left side of a rear portion of the engine body 15 and hence, a drive force of the engine can be transmitted to the rear wheel 7. A storable kickstand 29 is arranged at a lower portion of the left side of the vehicle body frame 5 and is capable of supporting the motorcycle 1 upright, with the vehicle body inclined toward the left side.

A cylinder body 30 of the engine body 15 is arranged above a crankcase 31, inclined slightly towards the front. Throttle bodies 32, which correspond to respective cylinders, are connected to a rear portion of the cylinder body 30. The upper ends of the respective throttle bodies 32 are connected to an air cleaner casing 33, which is arranged between the main frame member 12 and the fuel tank 14. Further, exhaust pipes 34, corresponding to respective cylinders, are connected to a front portion of the cylinder body 30. The exhaust pipes 34 are bent downwardly from the front wall of the cylinder body 30, pass below the crankcase 31 and, thereafter, are bent upwardly behind the pivot portion 9. As seen in FIG. 1, the exhaust pipes feed into and are connected to a sound muffler 35, which is supported on the seat frame 13.

Figure 3:
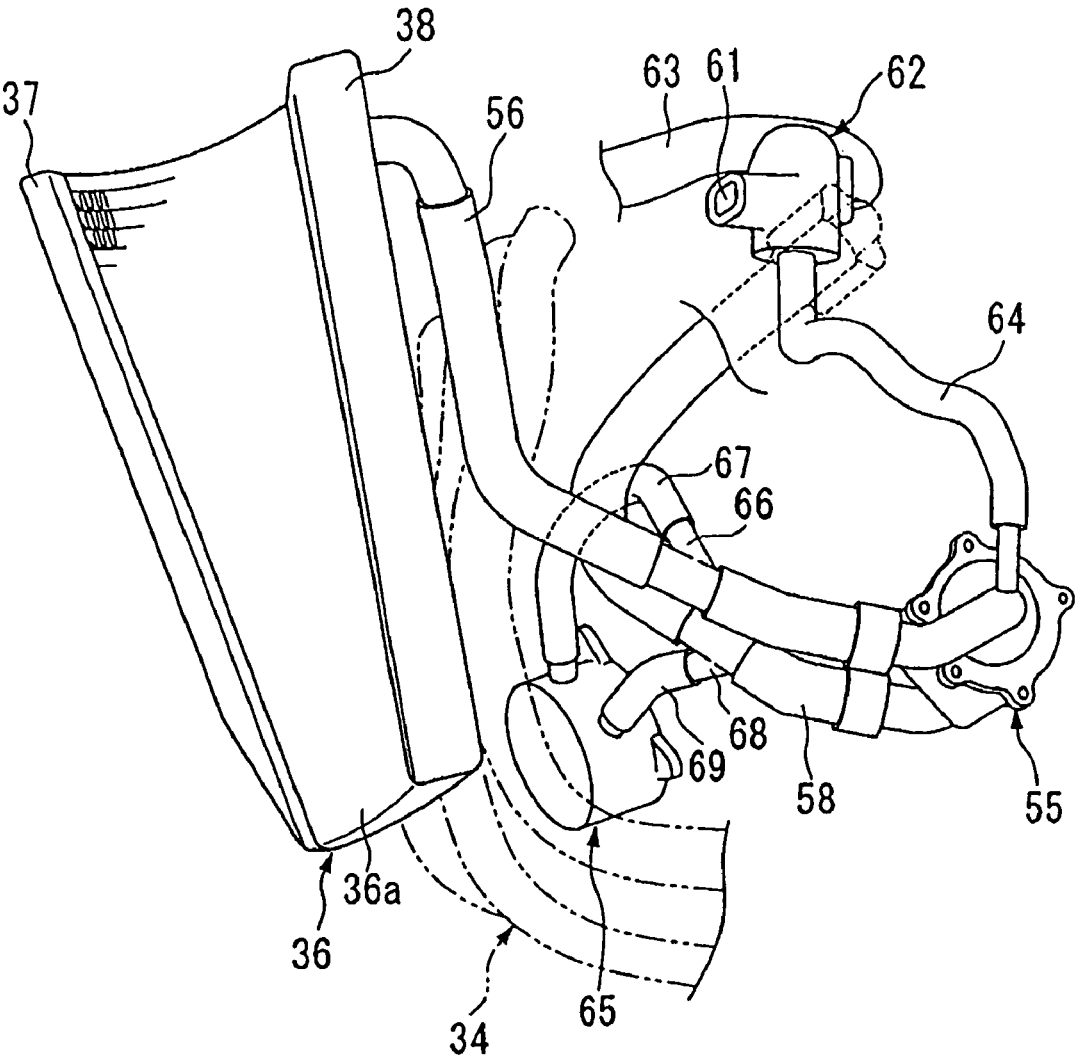
FIG. 3 is a partial perspective view of a coolant circulation passage of the engine of FIG. 2, with other components omitted for purposes of illustration.

In front of the exhaust pipes 34, a radiator 36 is arranged with the upper end thereof inclined slightly forwardly, in the same manner as the cylinder body 30. The radiator 36 is of a round curving type, which has a front face side thereof curved in a concave shape and, at the same time, as shown in FIG. 3, the radiator 36 is of a cross-flow type which provides a cooling-water inflow-side tank 37 to a right side of a radiator core 36*a* and a cooling-water outflow-side tank 38 to a left side of the radiator core 36*a*. The radiator 36 is formed in the vertical direction, and extends from an upper portion of the cylinder body 30 to a lower portion of the crank casing 31. A pair of left and right radiator fans, such as that shown at 39 in FIG. 1, are mounted on a back surface side of an upper portion of the radiator core 36*a*.

Figure 2:
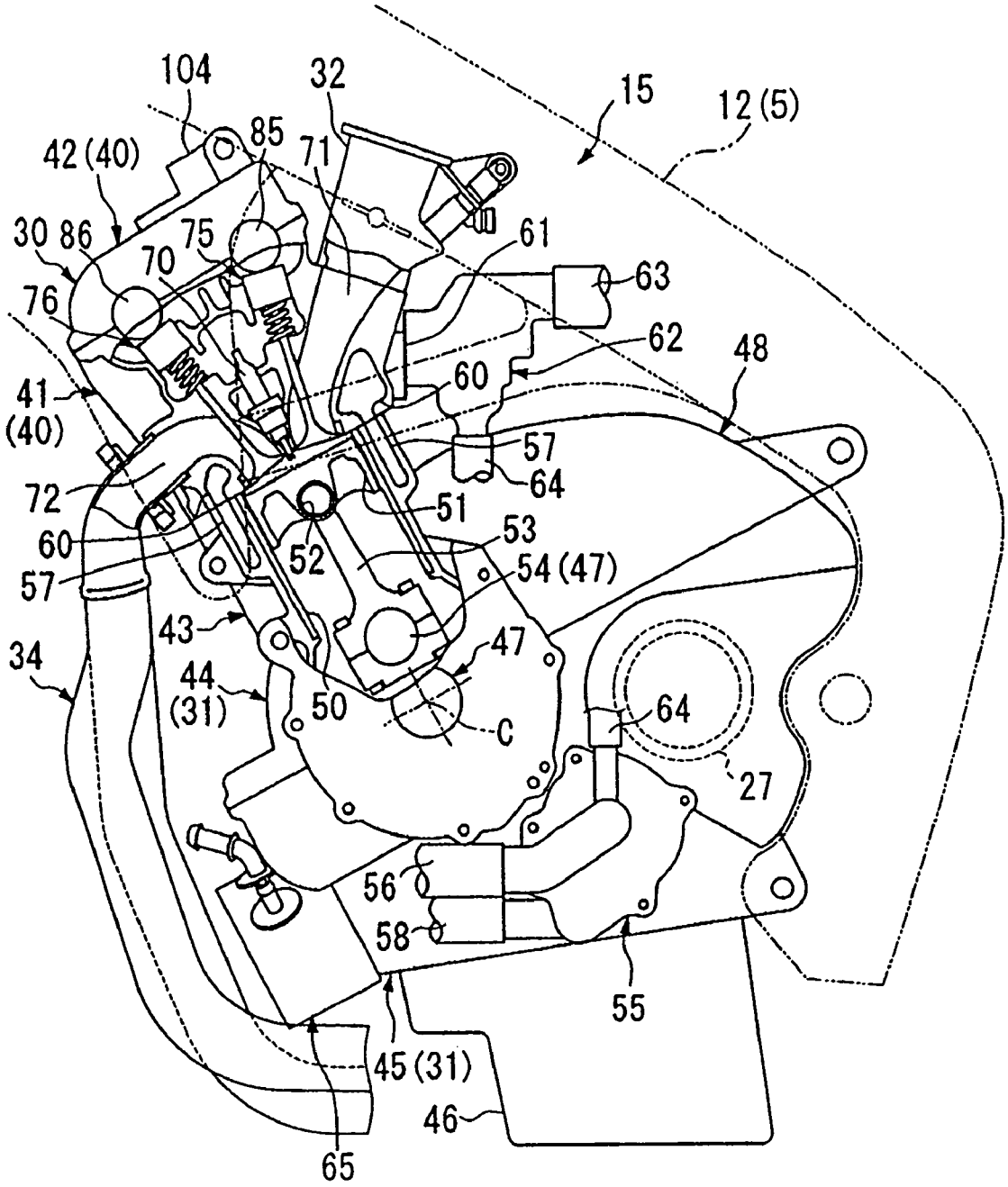
FIG. 2 is a side view, partially cut away, of an engine incorporating a cylinder head according to the first selected illustrative embodiment of the present invention.

To further explain the first embodiment hereof, also in conjunction with FIG. 2, the engine body 15 is provided with cylinder heads 40, cylinder blocks 43, and a crankcase 31 which constitute essential parts of the cylinder body 30. The cylinder head 40 is configured to be divided into a main casting body 41 and a valve cover 42, while the crankcase 31 is configured to be divided into an upper case 44 and a lower case 45. The upper case 44 and the cylinder block 43 are integrally molded, and an oil pan 46 is mounted below the lower case 45. Here, the main casting body 41 is a cast product made of an aluminum alloy.

Inside of the crankcase 31, a crankshaft 47, having an axis C parallel to the vehicle body width direction, is arranged. Further, a transmission case 48 is contiguously formed behind the crankcase 31, and a transmission and a clutch mechanism (both omitted from the drawing) are respectively arranged in the inside of the transmission case 48. Four cylinders 50 are formed in the cylinder block 43, such that these cylinders 50 are arranged in the vehicle body width direction. A piston 51 is slidably fitted into the inside of each cylinder 50. A connecting rod 53 is rotatably connected to each piston 51 by way of a piston pin 52 and, at the same time, a large end portion of the connecting rod 53 is rotatably connected to the crankpin 54 of the crankshaft 47, whereby the reciprocating motion of the piston 51 is converted into the rotary motion about the axis C.

To explain the operation of the cooling system also in conjunction with FIG. 3, a water pump 55, which is operated along with the rotation of the crankshaft 47, is arranged at the left side of the lower case 45. An outflow-side radiator hose 56, which is communicated with the outflow-side tank 38 of the radiator 36, and a coolant introduction hose 58, which is communicated with the cylinder-side water jacket 57 of the cylinder block 43, are respectively connected to the inlet and outlet sides of the water pump 55, as shown. A coolant inlet (not shown in the drawing) to the cylinder-side water jacket 57 is provided to a lower portion of the left side of the cylinder block 43. Coolant from the water pump, which flows into the cylinder-side water jacket 57 from the coolant inlet, passes through the cylinder-side water jacket 57 and, thereafter, coolant flows into a head-side water jacket 60 of the cylinder head 40.

A coolant outlet 61 from the head-side water jacket 60 is provided behind the cylinder head 40 and a thermostat 62 is directly mounted on the coolant outlet 61. An inflow-side radiator hose 63, which is in fluid communication with the inflow-side tank 37 of the radiator 36, is connected to a coolant outlet of the thermostat 62 and, at the same time, a bypass hose 64 is arranged between the thermostat 62 and the water pump 55.

Then, when the water pump 55 is operated along with the rotation of the crankshaft 47, coolant which is taken out from the outflow-side tank 38 of the radiator 36 through the outflow-side radiator holes 56 is introduced into the inside of the cylinder-side water jacket 57 through a coolant introduction hose 58. Coolant, which has passed through the cylinder-side water jacket 57, is introduced into the head-side water jacket 60 and, thereafter, is taken out from the coolant outlet 61 and is introduced into the inlet-side tank 37 of the radiator 36 through the thermostat 62 and the inflow-side radiator hose 63. Coolant passes through the radiator core 36*a*, where it is cooled by the radiation of heat therefrom, and returns to the inflow-side tank 37. Then, the coolant repeatedly circulates through the above-mentioned passages.

In the above-mentioned circulation, when the temperature of coolant which passes through the thermostat 62 becomes equal to or less than a fixed temperature, coolant is supplied to the water pump 55 from the thermostat 62 through the bypass hose 64, and is circulated through the radiator 36. Further, when the temperature of coolant which passes through the thermostat 62 becomes equal to or more than a fixed temperature, the radiator fan 39 is operated to draw air through the radiator 36, so as to forcibly cool coolant.

Further, a water-cooling type oil cooler 65 (FIG. 2), which cools the engine oil served for lubricating respective parts of the engine, is mounted on a front portion of the lower case 45. Coolant is introduced into the oil cooler 65 from a branch pipe 66, which is provided to a mid-portion of the coolant introducing hose 58 and an introduction hose 67. At the same time, coolant taken out from the oil cooler 65 is returned to the water pump 55 by way of a branch pipe 68 and a take-out hose 69 provided to a midst portion of the outflow-side radiator hose 56.

Figure 4:
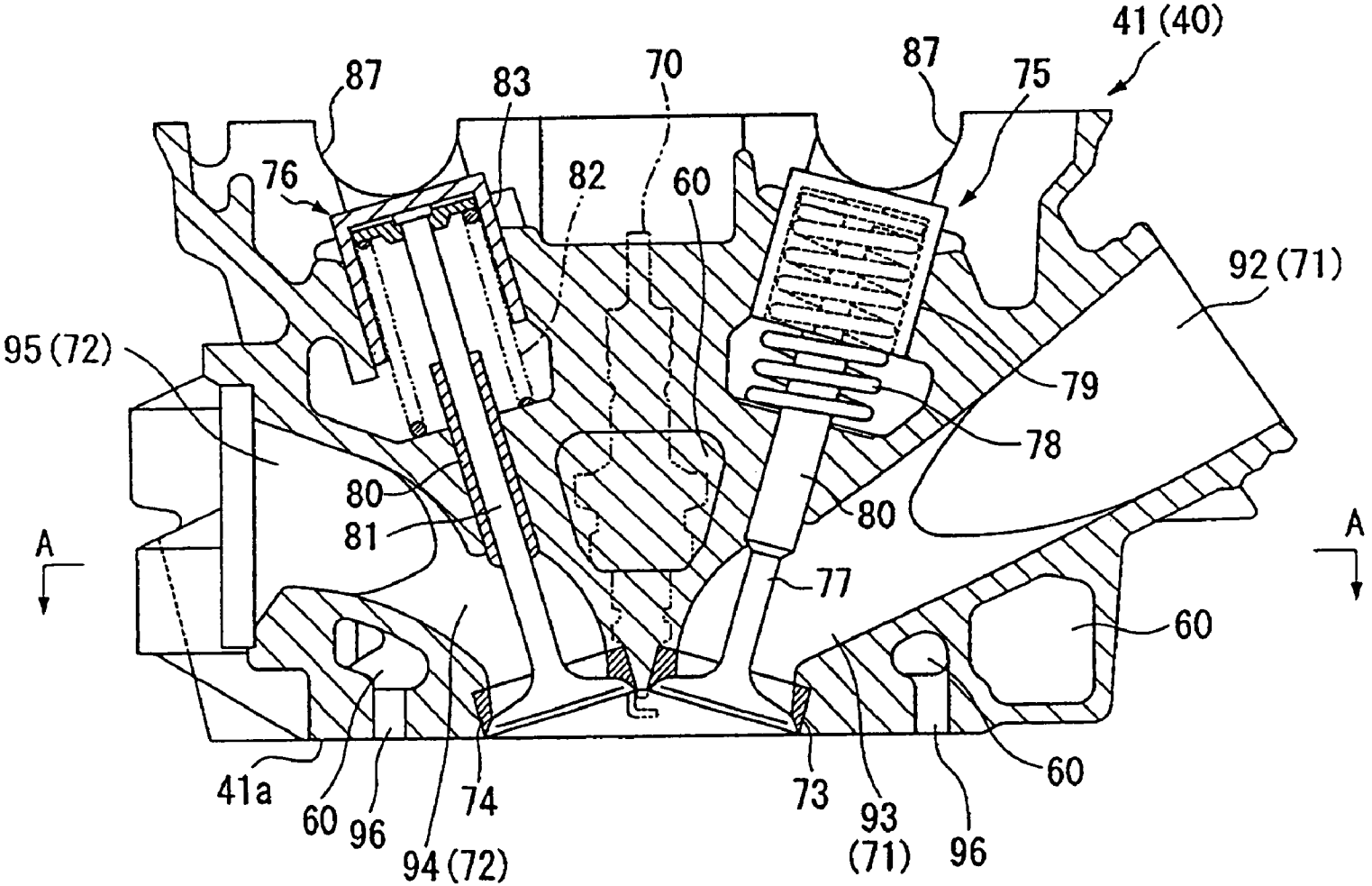
FIG. 4 is a cross-sectional view of a main casting body of the cylinder head according to the first embodiment, taken along a vertical plane transverse to the longitudinal axis.

To explain the embodiment also in conjunction with FIG. 4, spark plugs 70 are threadably mounted in the main casting body 41 of the cylinder head 40, such that the spark plugs 70 face the inside of the respective combustion chambers. At the same time, an intake port 71 and an exhaust port 72, which allow each combustion chamber to communicate with the outside, are respectively formed in the main casting body 41 of the cylinder head 40.

A throttle body 32 is connected to an outside opening of each intake port 71, and an exhaust pipe 34 is connected to an outside opening of each exhaust port 72. Further, valve seats 73, 74 are respectively mounted to combustion-chamber-side openings of each intake port 71 and each exhaust port 72, and these openings can be opened or closed in response to the operations of an intake valve 75 and an exhaust valve 76.

The intake valve 75 includes a valve stem 77 which has an umbrella-shaped valve body which actually opens and closes the opening of the intake port 71. The intake valve 75 also includes a valve spring 78 which biases the valve stem 77 upwardly so as to bring a face surface of a valve element into pressure contact with the valve seat 73. The intake valve 75 also includes a cylindrical valve lifter 79, which is mounted on an upper end of the valve stem 77 and the like, wherein the valve stem 77 is slidably inserted into a substantially tubular valve guide 80 which is mounted in the main casting body 41. Further, the exhaust valve 76 has the substantially same constitution as the intake valve 75. That is, the exhaust valve 76 includes a valve stem 81, a valve spring 82, a valve lifter 83, a tubular valve guide 80 and the like.

The cylinder head depicted in FIGS. 2 and 4 includes dual overhead camshafts 85, 86. An intake-side camshaft 85 and an exhaust-side camshaft 86 which operate the respective valves 75, 76 are respectively arranged above each intake valve 75 and exhaust valve 76, in parallel to the axis C of the crankshaft 47. An intake-side cam lobe corresponding to each respective intake valve 75, and an exhaust-side cam lobe corresponding to each respective exhaust valve 76 are formed on suitable respective peripheral surfaces of the intake-side camshaft 85 and the exhaust-side camshaft 86, respectively. Further, these camshafts 85, 86 are rotatably supported by bearings 87 of the main casting body 41 and a bearing cap (not shown).

The respective camshafts 85, 86 each have a hollow structure, wherein hollow portions constitute passages for transmitting a flow of engine oil, and the engine oil is supplied to respective slide surfaces from given oil holes. Further, cam sprocket wheels (not shown) are respectively formed on right ends of the respective camshafts 85, 86, and the respective camshafts 85, 86 are interlocked with the crankshaft 47 by way of cam chains wound around these cam sprocket wheels. Due to such a constitution, the respective camshafts 85, 86 are rotated concurrently with the rotation of the crankshaft 47, so as to operate the intake valves 75 and the exhaust valves 76.

Figure 5:
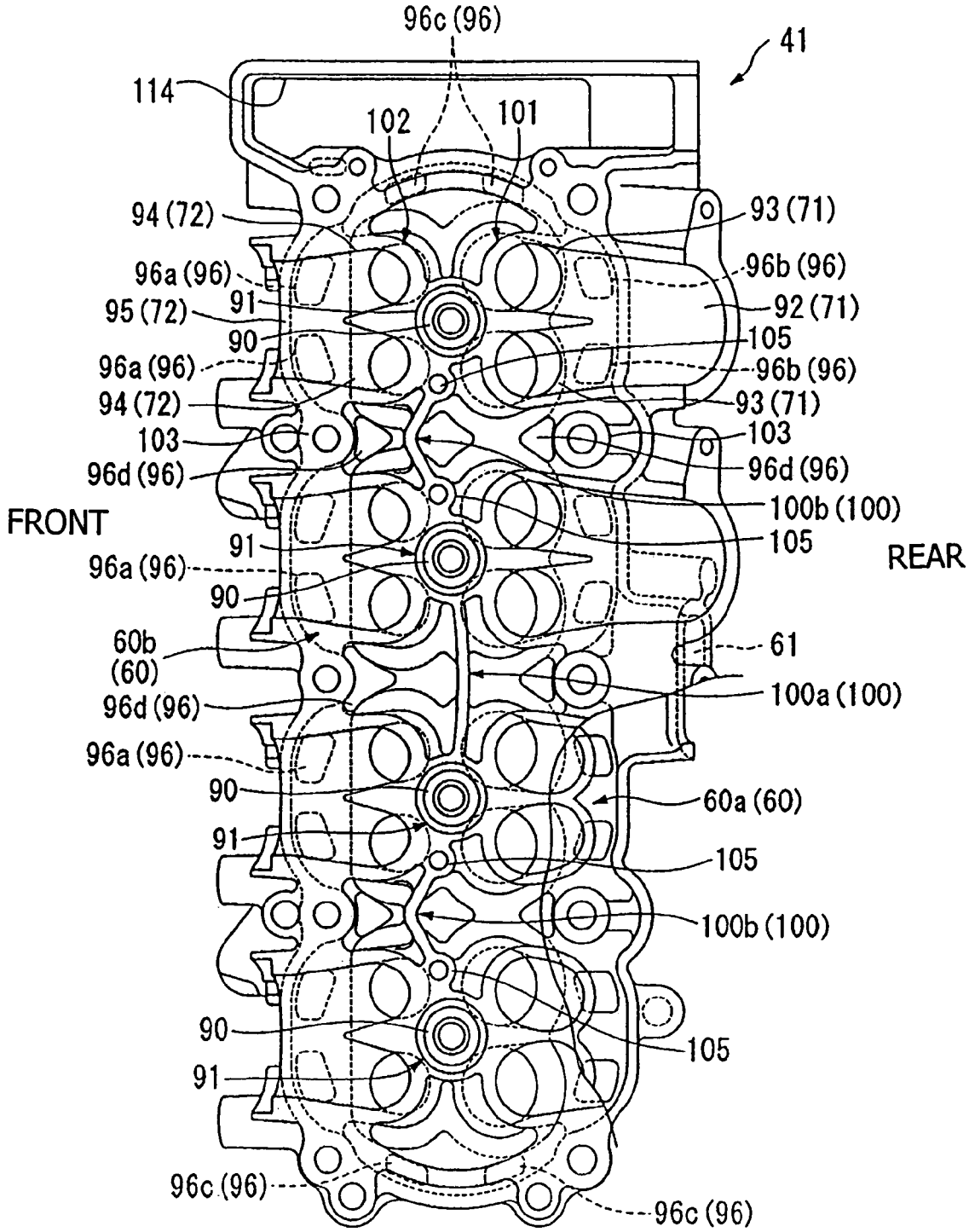
FIG. 5 is a cross-sectional view of the main casting body, taken along a horizontal plane passing through the line A—A in FIG. 4.

To explain the first selected embodiment also in conjunction with FIG. 5, plug holes 90, which correspond to four cylinders 50 arranged in the vehicle body width direction are formed in the main casting body 41, wherein the respective spark plugs 70 can be threadably mounted proximate the centers of ceiling portions of the combustion chambers. It will be understood that the cylinder head 41 depicted in FIG. 5 uses four valves per cylinder.

The intake port 71 is formed, corresponding to each combustion chamber, such that branch passages 93 are formed by bifurcating a main intake passage 92 which opens to the outside, and which is operatively connected to the air cleaner 33 via the throttle bodies 32. The respective branch passages 93 feed into the intake ports 71 at the combustion chambers. These two intake openings are arranged behind the plug hole 90, and at the same time, the valve seats 73 are mounted on the respective openings.

With respect to the exhaust port 72 openings to the combustion chamber, two openings are also formed for each combustion chamber. These two openings are arranged in front of the plug hole 90 and, at the same time, the valve seats 74 are mounted on the respective openings. That is, two branch passages 94 of the exhaust ports 72 communicate with the combustion chamber, and these branch passages 94 are merged to form a main exhaust passage 95.

In a mating surface 41*a* of the main casting body 41 for aligning with the cylinder block 43, a plurality of coolant communication openings 96 are formed, which allow fluid communication between a cylinder-side water jacket 57 and a head-side water jacket 60. To be more specific, front coolant communication openings 96*a* are respectively formed in the mating surface 41*a* in front of each exhaust port 72. Each front coolant communication opening 96*a* is formed in an approximately rectangular shape along a front surface of the main casting body 41. In the same manner, rear coolant communication openings 96*b* are respectively formed in the mating surface 41*a* behind the opening of each intake port 71, and each rear coolant communication opening 96*b* is formed in an approximately rectangular shape along a rear surface of the main casting body 41.

Further, assuming respective cylinders 50 as the first cylinder, the second cylinder, etc., in order from the left side, on the mating surface 41*a*, at the outside of the openings of the exhaust ports 72 and the openings of the intake ports 71 of the first cylinder and the fourth cylinder in the cylinder row direction, side coolant communication openings 96*c* which are formed in an elongated circular shape along side surfaces of the main casting body 41 are respectively formed. Further, between respective cylinders 50, a pair of front and rear intermediate coolant communication openings 96*d*, having an approximately triangular shape, are respectively formed.

The inflow of coolant into the head-side water jacket 60 is controlled by through holes formed in a head gasket, which is interposed between the main casting body 41 and the cylinder block 43. That is, by adjusting a shape, a position, and an area of the through holes formed in the head gasket, thus arbitrarily stopping or throttling the inflow of coolant into the respective coolant communication openings 96, it is possible to control a flow rate balance or the like of coolant in the head-side water jacket 60 which is relatively arranged in a complicated manner in the inside of the main casting body 41. Then, according to this embodiment, among the various coolant communication openings 96, coolant is made to flow into the inside of the head-side water jacket 60 mainly through the intermediate coolant communication opening 96*d* disposed between the second cylinder and the third cylinder and at the front-side (exhaust port 72 side), and through the front coolant communication openings 96*a* positioned at both sides of the intermediate coolant communication opening 96*d*.

On the main casting body 41, cylindrical plug hole walls 91 define the plug holes 90, intake port walls 101 and exhaust port walls 102 have a branch pipe shape and form the intake ports 71 and the exhaust ports 72. Elsewhere on the main casting body, a plurality of hollow bosses 103 are formed, which are used in joining the main casting body 41 to the cylinder block 43. Portions of the intake port walls 101 and the exhaust port walls 102 in the vicinity of the valve seats 73, 74 are densely arranged in the peripheries of the plug hole walls 91, and are integrally formed such that the portions in the vicinity of these respective walls merge together. The head-side water jacket 60 is formed as a hollow space inside of the main casting body 41 while avoiding the plug hole walls 91, the intake port walls 101, the exhaust port walls 102, the bosses 103 and the like. That is, the portions of the respective walls are arranged inside of the head-side water jacket 60.

A partition (a connection wall) 100 is also provided inside the head-side water jacket 60 between the neighboring plug hole walls 91, such that the partition 100 functions as a bridge to connect these walls. Each partition 100 is formed in an upstanding manner extending from an upper surface to a lower surface of the head-side water jacket 60, substantially parallel to the cylinder axis, and is integrally formed with the main casting body 41. Due to such partitions 100, a coolant passage of the head-side water jacket 60 is separated into an intake-port-side coolant passage 60*a* and an exhaust-port-side coolant passage 60*b* between the plug hole wall 91 for the first cylinder and the plug hole wall 91 for the fourth cylinder (see FIG. 6).

Figure 6:
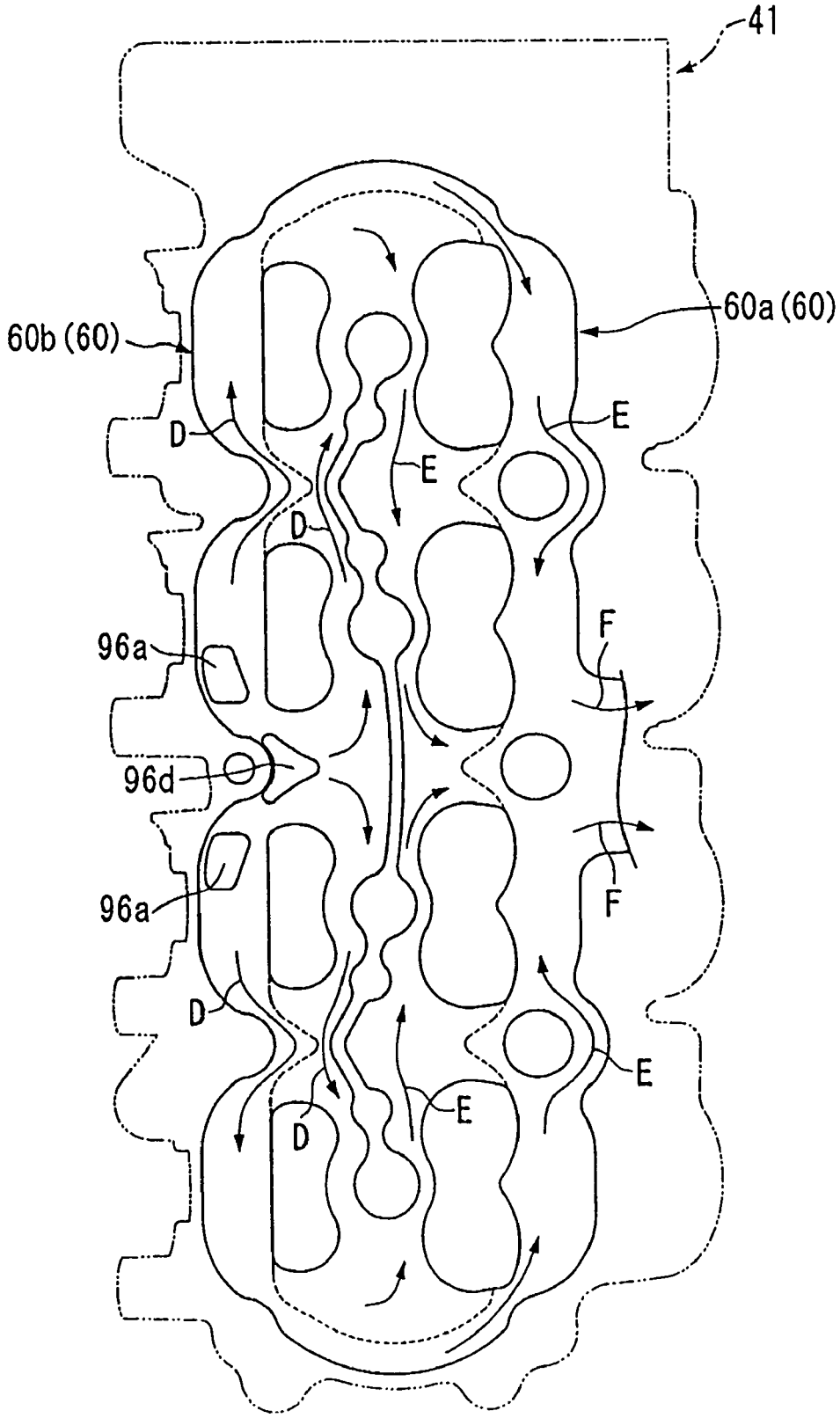
FIG. 6 is a simplified explanatory view of a head-side water jacket within the casting body of FIG. 4, and showing the outline of the casting body in phantom.

To explain the embodiment also in conjunction with FIG. 6, coolant which flows into the inside of the head-side water jacket 60 from the intermediate coolant communication opening 96*d* and the front-side coolant communication openings 96*a* formed at the left and right sides of the intermediate coolant communication opening 96*d* passes above and below the exhaust port walls 102 of respective cylinders 50 and, at the same time, flows toward the outside in the cylinder row direction (as shown by the arrows D in FIG. 6) while cooling the front portions of the plug holes 90 and the peripheries of the valve seats 74 of the exhaust ports 72. Coolant which reaches the outside of the first cylinder and the fourth cylinder is transferred from the exhaust-port-side coolant passage 60*b* to the intake-port-side coolant passage 60*a*. Then, coolant passes above and below the intake port walls 101 and, at the same time, flows toward the center of the main casting body 41 in the cylinder row direction, while cooling the rear portions of the plug holes 90 and the peripheries of the valve seats 73 of the intake ports 71 (as shown by the arrows E in FIG. 6). Then, coolant flows out to the outside of the head-side waterjacket 60 from a coolant outlet 61 formed between and behind the second cylinder and the third cylinder (as shown by the arrows F in FIG. 6), and is supplied to the thermostat 62 which is directly mounted in the coolant outlet 61.

The partition 100*a* formed between the second cylinder and the third cylinder is formed in an arcuate shape, slightly projecting toward the intake port 71 side in view of the relationship with a flow pattern of coolant. Further, the partitions 100*b* which are formed between the first cylinder and the second cylinder as well as between the third cylinder and the fourth cylinder are formed in a V-shape projecting toward the exhaust port 72 side thus preventing the generation of a vortex of coolant or the like in the exhaust-port-side coolant passage 60*b* which is the upstream side of the head-side water jacket 60 and exhibits a relatively fast flow speed (see FIG. 5). Here, hollow bosses 105 are formed on both end portions of the partition 100*b*, for receiving bolts which are used for fixing a breather chamber 104 (see FIG. 2), situated above the valve cover 42, to the main casting body 41.

Further, an air bleed hole (not shown) is formed in an upper portion of each partition 100, for preventing dwelling of air therein. That is, the air bleed hole suppresses the dwelling of air in the periphery of the partition 100 where the diameter of flow largely changes compared to the periphery of the plug hole wall 91. Further, since a portion of coolant flows into the intake-port-side coolant passage 60*a* from the exhaust-port-side coolant passage 60*a* through the air bleed hole and hence, the occurrence of the dwelling of coolant around the periphery of the partition 100 can be effectively prevented. Here, coolant which enters the intake-port-side coolant passage 60*a* through the air bleed hole is flowing at a sufficiently small volume compared to the amount of coolant which flows into the intake-port-side coolant passage 60*a* from the outside of the first cylinder and the fourth cylinder and hence, the flow of coolant in the inside of the head-side water jacket 60 shown in FIG. 6 can be maintained.

According to the above-mentioned first embodiment, by providing the partition 100 which connects the plug hole walls 91 to each other inside the head-side water jacket 60, the head-side water jacket 60 is separated into two sections, namely, the intake-port-side coolant passage 60*a* and the exhaust-port-side coolant passage 60*b*. Accordingly, coolant which flows into the head-side water jacket 60 first passes through the exhaust-port-side coolant passage 60*b* and, thereafter, extends around the outside end portion of the main casting body 41, and reverses direction. Then, the coolant passes through the intake-port-side coolant passage 60*a*, is merged at one position in the coolant outlet 61 which is provided at the central part of the main casting body 41, and the coolant then flows out to the outside of the head-side water jacket 60.

Accordingly, coolant flows uniformly inside the head-side water jacket 60 to both outer sides in the cylinder row direction and hence, the generation of a temperature gradient in the cylinder row direction can be suppressed, whereby it is possible to uniformly cool the cylinder head 40.

Further, coolant which flows into the inside of the head-side waterjacket 60 can be merged at one position in the coolant outlet 61 provided at the approximately center in the cylinder row direction and, thereafter, can be directed outside the main casting body 41. As a result, the coolant routing tubes and hoses outside the cylinder head 40 can be arranged simply and neatly.

Still further, by providing the air bleed hole in each partition 100, the occurrence of the staying or dwelling of air in the periphery of the partition 100 can be effectively prevented whereby the cooling performance of the cylinder head 40 can be held in a favorable state.

Further, since the respective plug hole walls 91 are connected by the partitions 100, at the time of producing the main casting body 41 by casting, the partition 100 portion functions as a molten metal passage around the plug hole walls 91. Although the periphery of the plug hole wall 91 of the main casting body 41 is in the state that the intake port wall 101, the exhaust port wall 102 and the like are densely arranged therein, by adding the molten metal passage to such a portion, the flow of molten metal is enhanced whereby the quality of cast product can be enhanced and a yielding rate of the cast products can be also enhanced.

Still further, it is possible to reinforce the portion of the main casting body 41 between the respective cylinders 50 by the partitions 100 formed in the inside of the head-side water jacket 60 above the portion. The portion of the main casting body 41 between the respective cylinders 50 seals the combustion chamber and hence, the portion requires a given strength and rigidity. By reinforcing the portion with the partition 100, it is possible to reduce a wall thickness of the main casting body 41 and hence, the weight of the main casting body 41 can be also reduced.

Next, the second embodiment of the present invention will be explained, based on FIG. 7 and FIG. 8, and also referring back to FIGS. 1 through 6 for features which are shared with the first embodiment.

This second embodiment differs from the first embodiment in that, in place of the air bleed hole (of the first embodiment) formed in each partition 100, an access hole plug, (sand removing plug) 111 for plugging an access hole 110 which is necessary at the time of casting, is provided above each partition 100 and, at the same time, a gap S is defined between an upper periphery of each partition 100 and a distal end of the plug 111. Here, parts identical with the parts of the first embodiment are given same symbols as those used in connection with the first embodiment, and their explanation is omitted.

Figure 7:
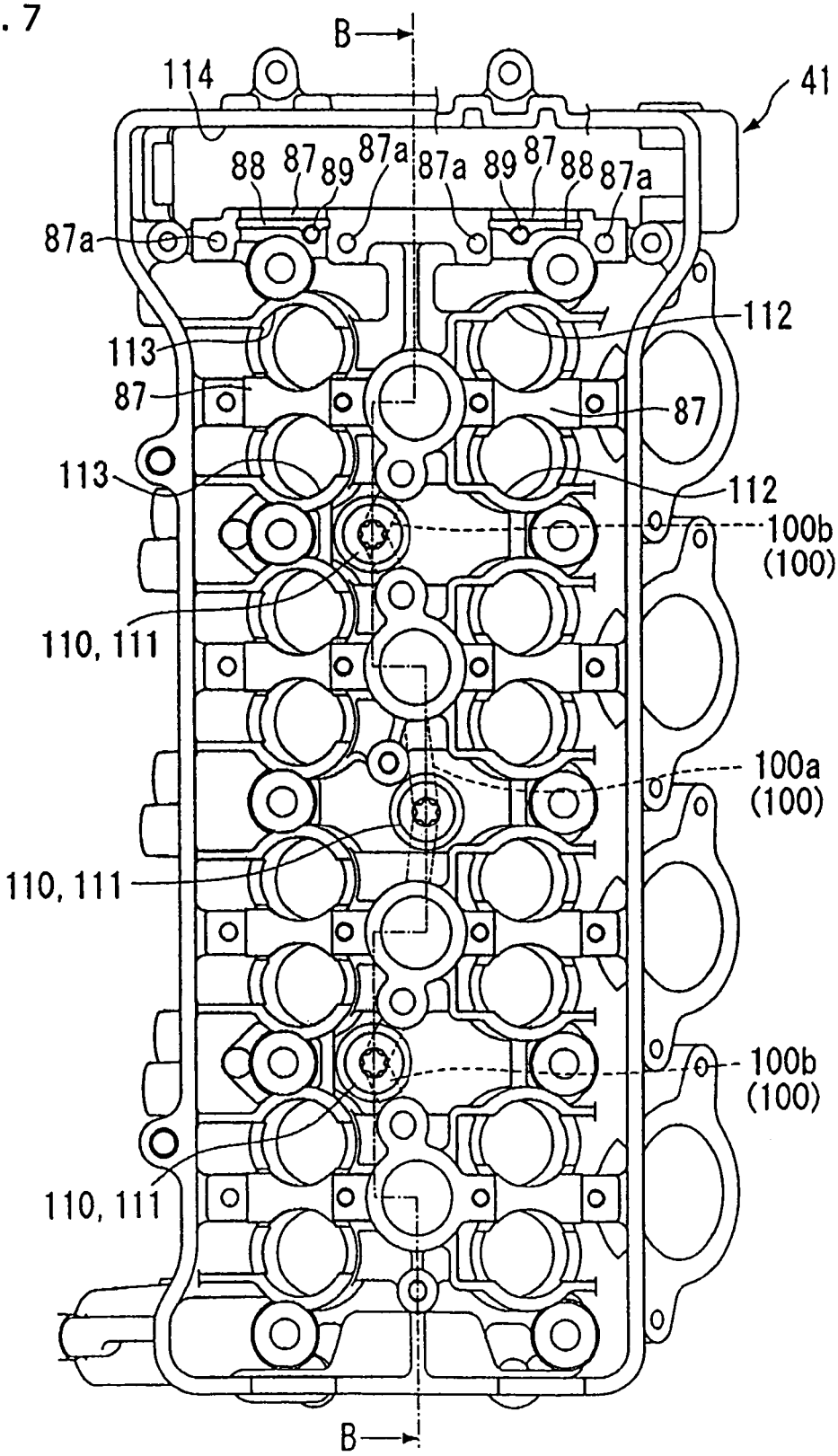
FIG. 7 is a top plan view of a main casting body according to a second illustrative embodiment of the present invention.

As shown in FIG. 7, in a cylinder head according to the second embodiment, guide walls 112, 113 are provided on the main casting body in front of and behind four plug hole walls 91, corresponding to respective cylinders 50. Each pair of guide walls 112, 113 slidably support the valve lifters 79, 83 of the respective intake and exhaust valves 75, 76.

Camshaft bearings 87 are installed on the main casting body between each pair of the guide walls 112, 113, and between respective rightmost guide walls 112, 113 and a cam chain case 114. The camshaft bearings 87 rotatably support journal portions of the intake-side camshaft 85 and the exhaust-side camshaft 86. Oil grooves 88, and oil passages 89 which open inside the oil grooves 88, are formed in slide surfaces of the bearings 87, which are provided between the respective rightmost guide walls 112, 113 and the cam chain case 114. Due to such a constitution, an engine oil supplied through the oil passages 89 is supplied to respective slide surfaces by way of the oil grooves 88 and the hollow portions of the respective camshafts 85, 86. The main casting body also has bolt holes 87*a* formed therein, in front of and behind respective bearings 87, for fixing a bearing cap in place.

Figure 8:
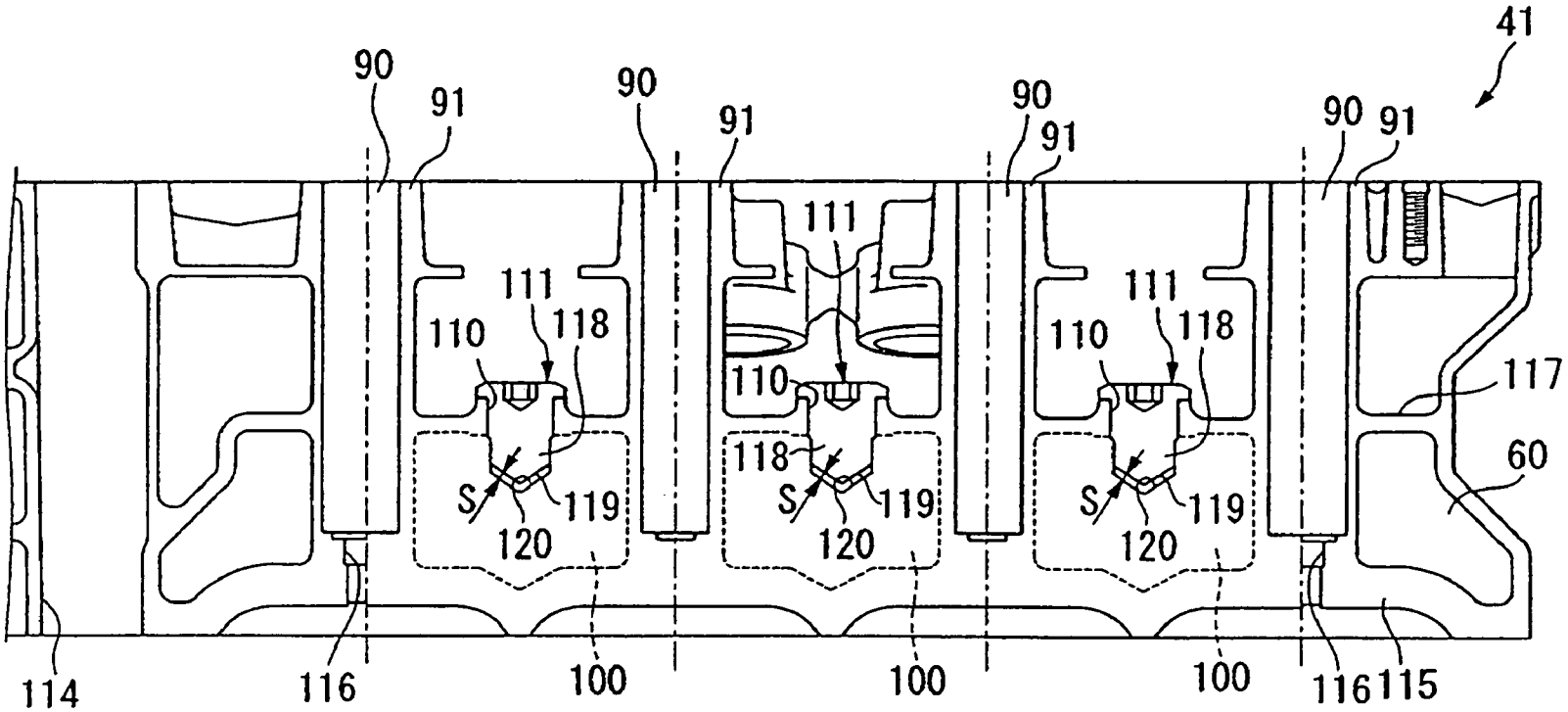
FIG. 8 is a longitudinal cross-sectional view of the casting body of FIG. 7, taken along the line B—B in FIG. 7.

To explain this embodiment also in conjunction with FIG. 8, in a bottom wall 115 of the main casting body 41 which forms a ceiling portion of each combustion chamber, a thread hole 116 is formed, in which the spark plug 70 is threadably mounted, after it has been inserted into the plug hole 90. Further, an upper partition 117 is provided above the bottom wall 115 and a space which is sandwiched and closed by the upper partition 117 and the bottom wall 115 defines the head-side water jacket 60. Each partition 100 is formed in an upstanding manner from an upper surface of the bottom wall 115 to a lower surface of the upper partition 117, so as to separate the head-side water jacket 60 between the neighboring plug hole walls 91.

Here, with respect to the main casting body 41 which is a cast product, the head-side water jacket 60 is formed by setting a core produced by solidifying exclusive-use sands in the inside of a mold, by crushing the core after casting, and by pulling out the crushed sands to the outside. To enable such an operation, a proper number of access holes 110 are respectively formed in the upper partition 117 which is disposed above the respective partitions 100. Portions of upper peripheral portions of the partitions 100 are cut away to form these respective access holes 110 and hence, the head-side water jacket 60 opens to the outside, whereby the sands can be removed. Then, after removing the sands, the plugs 111 are threadably engaged with the access holes so as to plug the access holes, whereby it is possible to make coolant flow into the inside of the head-side water jacket 60.

A pilot portion 118 having a diameter which exceeds a thickness of the partition 100 is formed on a distal end portion of each plug 111. A distal end of the pilot portion 118 is formed in a flat conical shape. An alignment portion 120 having a funnel or concave shape corresponding to a conical portion 119 is formed in the cut-away portion of each partition 100. Here, the distal end portion of the plug 111 is set such that, in a state that the plug 111 is threadably engaged in the access hole 110, a gap S is formed between the conical portion 119 and the alignment portion 120 and a portion of coolant in the inside of the exhaust-port-side coolant passage 60*b* can flow into the intake-port-side coolant passage 60*a* through the gap S. The gap S substantially functions in the same manner as the air-bleed hole of the first embodiment whereby the occurrence of air dwelling in the periphery of the partition 100 can be prevented and, at the same time, the occurrence of dwelling of coolant can be also prevented.

According to the above-mentioned second embodiment, in the same manner as the first embodiment, it is possible to uniformly cool the cylinder head 40, to make the coolant piping outside the cylinder head 40 simple and neat, to improve the productivity of the main casting body 41, and to reduce the weight of the main casting body 41. Further, by providing the access hole 110 which cuts away the portion of each partition 100, after casting the main casting body 41, sands can be removed simultaneously from the intake-port-side coolant passage 60*a* and the exhaust-port-side coolant passage 60*b* of the head-side water jacket 60. Still further, by forming the gap S between the sand-removing-hole plug 111 and the partition 100, the dwelling of air, the local boiling or the like around the periphery of the partition 100 where the diameter of coolant flow largely changes can be surely prevented whereby it is possible to maintain the head-side water jacket 60 in a state that the favorable cooling performance can be achieved.

Here, the present invention is not limited to the above-mentioned embodiments and the present invention is applicable to a parallel four cylinder type internal combustion engine provided that the engine includes a plurality of cylinders. Further, the present invention is not limited to the motorcycle. That is, not mention a three-wheeled vehicle and a four-wheeled vehicle, the present invention is also applicable to the whole multi-cylinder water-cooled type internal combustion engines.

As has been explained heretofore, according to the invention described in the first aspect, it is possible to make coolant flow from both sides in the cylinder row direction to the downstream side due to the connection walls each of which is formed between the plug hole walls and hence, the flow of coolant can be easily made uniform in the cylinder row direction, whereby substantially uniform cooling can be achieved.

Further, by connecting the respective plug hole walls using the connection walls, the flow of molten metal around the plug hole walls where the intake passages, the exhaust passages and the like are densely arranged is improved whereby it is possible to enhance a yield rate by suppressing the occurrence of casting failure.

Still further, since the mating surface of the cylinder head with the cylinder block between the respective cylinders is reinforced by the connection walls, it is possible to reduce the wall thickness around the mating surface whereby the weight of the cylinder head can be reduced.

According to the invention described in the second aspect, it is possible to make coolant flow from both sides in the cylinder row direction directed to the downstream side due to the partitions each of which is formed between the plug hole walls and hence, the flow of coolant can be easily made uniform in the cylinder row direction whereby substantially uniform cooling can be achieved.

Further, by connecting the respective plug hole walls using the partitions, the flow of molten metal around the plug hole walls where the intake passages, the exhaust passages and the like are densely arranged is improved whereby it is possible to enhance a yield rate by suppressing the occurrence of casting failure.

Still further, since the mating surface of the cylinder head with the cylinder block between the respective cylinders is reinforced by the partitions, it is possible to reduce the wall thickness around the mating surface whereby the weight of the cylinder head can be reduced.

Further, by providing the gap between the sand removing plug and the partition, the occurrence of dwelling or staying of air in coolant between the plug hole walls can be suppressed and the occurrence of local boiling or the like can be prevented whereby it is possible to maintain the cooling performance in the favorable state.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A cylinder head for an internal combustion engine, comprising:

a main casting body having a hollow water jacket formed therein to allow coolant flow therethrough, said main casting body comprising:

a plurality of plug hole walls extending through said water jacket and having plug holes formed therein to receive spark plugs, and a connection wall comprising a plurality of partitions which connect adjacent plug hole walls with each other in the water jacket, wherein at least one of the partitions of said connection wall is non-linear in shape when viewed in horizontal cross section.

2. The cylinder head of claim 1, wherein said plug hole walls and partitions cooperate to divide said water jacket into an exhaust port water jacket section and an intake port water jacket section.

3. The cylinder head of claim 1, wherein at least one of said partitions has a cross-sectional V shape.

4. The cylinder head of claim 1, wherein the main casting body is configured to support two camshafts thereon.

5. The cylinder head of claim 1, wherein the main casting body is configured to support four valves per cylinder.

6. The cylinder head of claim 1, wherein the connection wall comprises enlarged bosses with holes formed therein to receive fasteners.

7. The cylinder head of claim 1, wherein at least one of said partitions is formed in a cross-sectional V shape projecting toward the exhaust port section of the water jacket, and at least one of said partitions is bowed outwardly towards the intake port section of the water jacket.

8. A cylinder head for an internal combustion engine, comprising:

a main casting body having a hollow water jacket formed therein to allow coolant flow therethrough, said main casting body comprising:

a plurality of plug hole walls extending through said water jacket and having plug holes formed therein to receive spark plugs, and a connection wall comprising plurality of partitions which connect adjacent plug hole walls with each other in the water jacket, wherein said plug hole walls and partitions cooperate to divide said water jacket into an exhaust port water jacket section and an intake port water jacket section;

wherein said water jacket defines a flow path in which coolant enters the main casting body at the exhaust port section of the water jacket, where the flow path splits into two parts and flows in two substantially opposed directions from a medial area of the main casting body towards the ends of the main casting body, and wherein the flow path extends around the connection wall at each end of the main casting body where each respective part of the flow path substantially reverses direction, and the two parts of the flow path then flow toward one another through the intake port section of the water jacket, and exit the main casting body via a coolant outlet located at a medial area thereof.

9. A cylinder head for an internal combustion engine, comprising:

a main casting body having a hollow water jacket formed therein to allow coolant flow therethrough, said main casting body comprising:

a plurality of plug hole walls extending through said water jacket and having plug holes formed therein to receive spark plugs, and a connection wall comprising a plurality of partitions which connect adjacent plug hole walls with each other in the water jacket, wherein a central one of said partitions is bowed outwardly towards the intake port section of the water jacket.

10. A cylinder head for an internal combustion engine, comprising:

a main casting body having a hollow water jacket formed therein to allow coolant flow therethrough, said main casting body comprising:

a plurality of plug hole walls extending through said water jacket and having plug holes formed therein to receive spark plugs, and a connection wall comprising a plurality of partitions which connect adjacent plug hole walls with each other in the water jacket;

wherein said plug hole walls and partitions cooperate to divide said water jacket into an exhaust port water jacket section and an intake port water jacket section; and wherein said water jacket defines a coolant flow path in which coolant enters the intake port water jacket section, flows around the ends of the connection wall to the exhaust port water jacket section, and exits from a medial portion of the main casting body.

11. The cylinder head of claim 10, wherein coolant enters the main casting body at the exhaust port section of the water jacket, where the flow path splits into two parts and flows in two substantially opposed directions from a medial area of the main casting body towards the ends of the main casting body, and wherein the flow path extends around the connection wall at each end of the main casting body where each respective part of the flow path substantially reverses direction, and the two parts of the flow path then flow toward one another through the intake port section of the water jacket, and exit the main casting body via a coolant outlet located at a medial area thereof.

12. The cylinder head of claim 10, wherein at least one of said partitions has a cross-sectional V shape.

13. The cylinder head of claim 10, wherein a central one of said partitions is bowed outwardly towards the intake port section of the water jacket.

14. The cylinder head of claim 10, wherein the main casting body is configured to support two camshafts thereon.

15. The cylinder head of claim 10, wherein the main casting body is configured to support four valves per cylinder.

16. The cylinder head of claim 10, wherein the connection wall comprises enlarged bosses with holes formed therein to receive fasteners.

17. The cylinder head of claim 10, wherein at least one of said partitions is formed in a cross-sectional V shape projecting toward the exhaust port section of the water jacket, and at least one of said partitions is bowed outwardly towards the intake port section of the water jacket.

18. A cylinder head for an internal combustion engine, comprising:

a main casting body having a hollow water jacket formed therein to allow coolant flow, said main casting body comprising a plurality of plug hole walls extending through said water jacket and having plug holes formed therein, and at least one partition extending between the plug hole walls, said partition dividing the inside of the water jacket into sections, a portion of said partition having an access hole formed therein; and a sand removing plug disposed in the access hole in said partition;

wherein a gap is formed between the sand removing plug, which is mounted in the access hole, and the partition.

* * * * *